United States Patent [19]

Greene et al.

[11] Patent Number: 4,572,663

[45] Date of Patent: Feb. 25, 1986

[54] METHOD AND APPARATUS FOR SELECTIVELY ILLUMINATING A PARTICULAR BLADE IN A TURBOMACHINE

[75] Inventors: Kenneth H. Greene, Latrobe; Carl H. Geary, Greensburg, both of Pa.

[73] Assignee: Elliott Turbomachinery Co., Inc., Jeannette, Pa.

[21] Appl. No.: 564,141

[22] Filed: Dec. 22, 1983

[51] Int. Cl.[4] ..... G01P 3/40

[52] U.S. Cl. ..... 356/23; 358/106

[58] Field of Search ..... 356/375, 23; 358/105–107; 415/118

[56] References Cited

U.S. PATENT DOCUMENTS

| | | | |
|---|---|---|---|
| 3,178,510 | 4/1965 | Rosin et al. | 178/6.8 |
| 3,275,744 | 9/1966 | Dietrich | 178/6 |
| 3,841,763 | 10/1974 | Lewis | 356/207 |
| 3,847,487 | 11/1974 | Boll | 356/207 |
| 4,126,396 | 11/1978 | Hartmann et al. | 356/434 |
| 4,180,329 | 12/1979 | Hildebrand | 356/23 X |
| 4,202,398 | 5/1980 | Osugi | 164/150 |
| 4,326,804 | 4/1982 | Mossey | 356/375 |

FOREIGN PATENT DOCUMENTS

| | | | |
|---|---|---|---|
| 27946 | 5/1981 | European Pat. Off. | 356/23 |
| 2060194 | 4/1981 | United Kingdom | 356/23 |

*Primary Examiner*—F. L. Evans

*Attorney, Agent, or Firm*—Robert P. Hayter

[57] ABSTRACT

A method and apparatus for monitoring the condition of blades mounted to a rotary shaft in a turbomachine by selectively illuminating a particular blade in a turbomachine. A control system for determining when to initiate a strobe light in response to a shaft position for illuminating a particular blade is described. Additionally, indexing means for automatically sequencing through the blades is further disclosed. A camera for remote monitoring of the blades using an automatic control system is further provided.

16 Claims, 3 Drawing Figures

METHOD AND APPARATUS FOR SELECTIVELY ILLUMINATING A PARTICULAR BLADE IN A TURBOMACHINE

BACKGROUND OF THE INVENTION

1. Field of the Invention

This invention relates to a system for monitoring turbomachine blade wear, and particularly to a system suitable for enabling an operator to remotely monitor blade wear. This invention further concerns selectively strobing a light to illuminate a particular blade or to automatically sequentially view blades in a predetermined pattern.

In recent years it has become desirable to employ turbomachines such as gas expanders in relatively harsh environments. In these harsh environments, the motivating fluid furnished to the turbomachine may be a "relatively dirty" gas containing much particulate matter. The particulate matter will cause erosion or other undesirable wear of the blades of the turbomachine.

As an example, gas expanders have been employed in association with fluid catalytic cracking processes (hereinafter F.C.C. process) employed by the petroleum industry. The gas expanders have been used to recover energy from waste heat gas streams which may contain entrained particulates such as catalyst particles. In particular, the expander receives the waste heat gas generated within a regenerator of the F.C.C. process whereby the waste heat gas functions as a motivating fluid for the expander. The expansion of the gas through the expander results in the generation of usable power. Similar expanders are used in coal gasification and analogous processes for recovering energy.

Generally, gas expanders of the foregoing type are located in positions which discourage constant monitoring by operating personnel. Although particulate matter separators are employed upstream of the expander not all particulate matter is removed. Further, the separator may become inoperative or the process conditions may change allowing large quantities of particulates to pass into the turbomachine. Impingement of particulates on the rotating blades will cause blade erosion. Erosion is generally a function of the quantity and size of particulate matter impinging on the blades. In multi-stage expanders, the blades mounted on the stage with the greatest operating load will be subject to the highest degree of erosion. Further, the trailing edge of the blade, as the thinnest portion thereof, is susceptible to the most significant erosion damage.

Even with operating separators, blades will constantly be undergoing erosion with the rate of erosion sometimes increasing substantially due to changes in the operating conditions of the F.C.C. process including such changes as process upsets. If blade wear due to erosion is not adequately monitored, one or more of the blades may fail causing severe, and in some circumstances, catastrophic events.

In addition to the foregoing, turbomachines such as steam turbines, may have blade failures due to carryover of moisture in the motivating fluid. In particular, moisture contained in the motivating fluid will impinge upon the blades of the turbomachine stages and effectively erode these blades.

SUMMARY OF THE INVENTION

It is an object of the present invention to provide a system for monitoring the condition of blades mounted to a rotary shaft in a turbomachine.

It is a further object of the present invention to enable operating personnel to monitor blade wear on a continuous basis.

It is a yet further object of the present invention to provide a control means for constantly monitoring the erosion condition of a selected blade in a turbomachine.

It is a still further object of the present invention to generate an image of one of the blades and to display that image to determine wear of the blade.

It is a still further object of the present invention to monitor the blades of a turbomachine by transmitting an image of at least one of the blades to a viewing station located at a point remote from the turbomachine.

Another object of the present invention is to provide a control system for a strobe light capable of selecting which blade in the machine is to be illuminated.

It is a yet further object of the present invention to provide automatic sequencing means for energizing a strobe light in a known pattern to monitor the condition of a series or all the blades in the machine.

It is another object of the present invention to provide a safe, economical and reliable method of monitoring blade wear in a turbomachine.

These and other objects of the present invention are achieved according to a preferred embodiment of the machine by providing a method of monitoring the condition of blades mounted to a rotary shaft in a turbomachine. The method includes detecting the rotational position of the shaft, generating a signal in response to the position of the shaft, dividing the signal into a plurality of position signals each representing a portion of a revolution of the shaft, determining the rotational position of the shaft by monitoring the position signals, illuminating at least one blade when the step of determining ascertains that the shaft is in a rotational position such that the blade to be inspected is in the desired position. The invention may further include transmitting an image of the illuminated blade to a remote viewing station.

The present invention further includes apparatus for inspecting the blades on a shaft of a turbomachine which comprises a detector for ascertaining when the shaft is in a preselected rotational position and generating a signal in response thereto, means for dividing the signal into a series of position signals each representing a rotational position of the shaft, a strobe means for illuminating a blade to be inspected and means for triggering the strobe means in response to the position signals when the blade is in the desired position.

The present invention further comprises indexing means for periodically changing the blade which is illuminated such that different blades may be sequentially inspected.

DESCRIPTION OF THE PREFERRED EMBODIMENT

The invention herein will be described with reference to a monitoring system for use with a hot gas expander utilizing a strobe light and a camera. It is to be understood that this invention has like applicability to all turbomachinery wherein a strobe light is energized in response to a sensed position on a shaft. It is to be further understood that this invention has like applicability to other types of turbomachinery and additionally applies to visual inspection of the blade as well as remote inspection by use of a camera.

Figure 1:
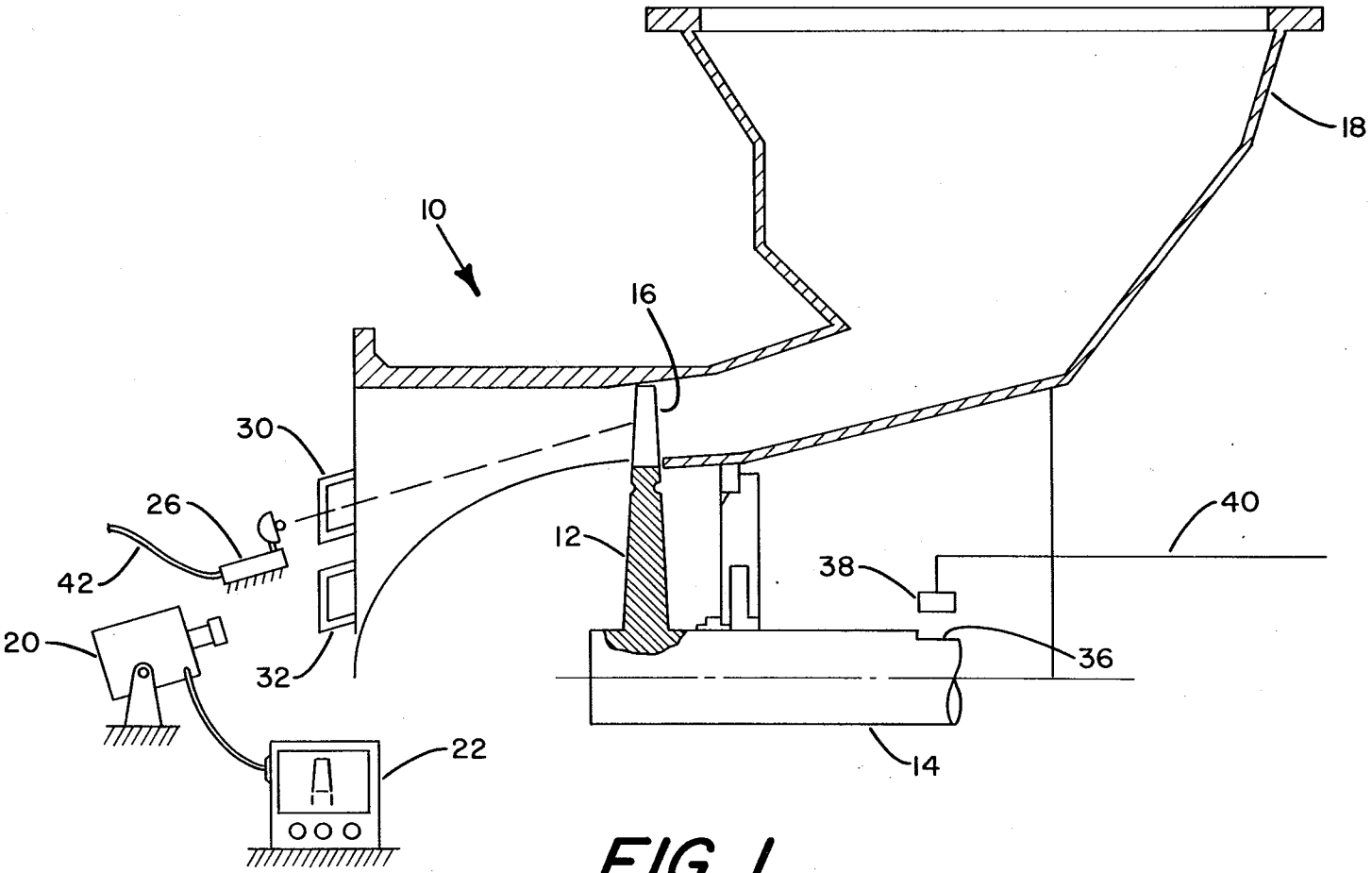
FIG. 1 is a schematic representation of a gas expander including a strobe light and a camera for viewing the blade to be inspected.

Referring first to FIG. 1 there may be seen a turbomachine 10 which is shown as a gas expander. Turbomachine 10 includes shaft 14 having a stage 12 mounted radially therefrom including blades 16 for converting energy in the hot gas stream into shaft work. It is blades 16 which are subject to erosion and need to be monitored to determine the condition thereof.

Hot gas enters the machine from the left hand side and passes through blades 16 causing the shaft to rotate. The gas is then discharged upwardly through exhaust casing 18.

Shaft 14 defines a keyway 36 therein. Detector 38 is an eddy current detector shown located adjacent the shaft where it defines the keyway such that via the change in magnetic conditions due to the keyway detector 38 will detect each time the keyway is rotated past the detector position and generate a signal in response thereto. Wire 40 is shown connected to detector 38.

Ports 30 and 32 are located upstream, in this instance, of blade 16 and include a transparent section for allowing light to pass into and out of the chamber in which the blades are mounted. Strobe light 26 is connected to wire 42 and is shown located to direct light through port 30 to blade 16. Camera 20 is located such that it may view blade 16 through port 32. The signal from camera 20 is directed to TV receiver 22. The signal may be observed simultaneously while the machine is operated, may be recorded on a video tape recorder for future use or a photograph thereof may be taken to establish a permanent library of the relative conditions of the blades.

Figure 2:
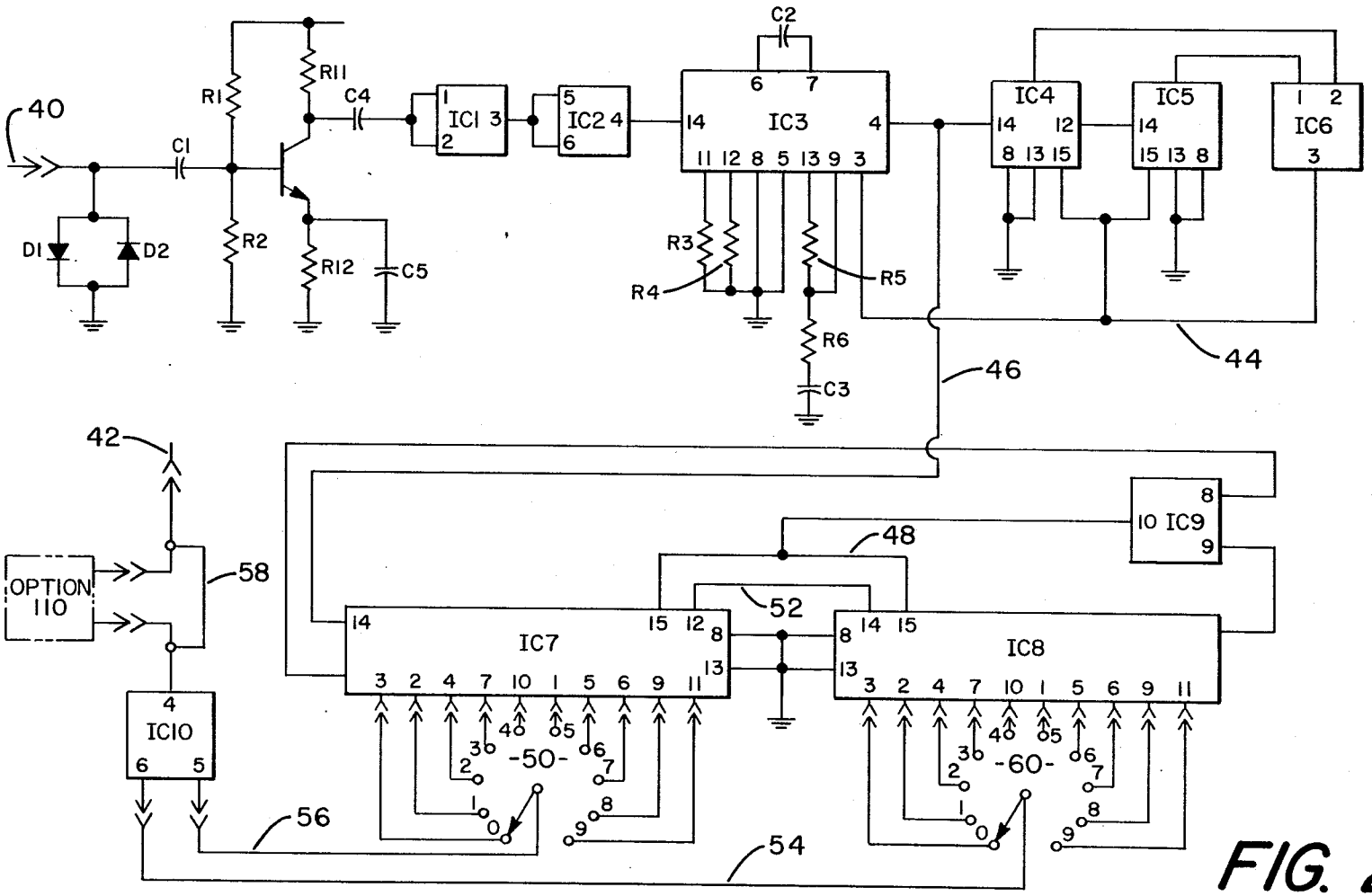
FIG. 2 is a wiring schematic of the circuit for appropriately energizing a strobe light.

Referring now to FIG. 2 there may be seen a wiring schematic utilized to appropriately trigger the strobe light such that the particular blade desired is viewed. Wire 40 from the detector is shown entering the top left hand portion of the schematic. A signal conditioning arrangement is provided thereafter. Diodes D1 and D2 are arranged to effect amplitude limiting of the incoming signal. The signal then flows through a capacitor to effect wave shaping and additionally flows to the base of transistor Q1. Q1, acting in combination with capacitor C4 and the various resistors as shown, generates a pulsed wave form. This signal is then directed to IC1 which is a two input nand Schmidt trigger. From there the signal flows to IC2 which is an inverter for reversing the signal. All of the above acts to effectively condition the signal such that a pulse of predetermined width is directed to IC3 at the rate of one pulse for each revolution of the shaft.

IC3 is a phase locked loop capable of acting in combination with IC4, IC5 and IC6 for generating a series of pulses. Each pulse is designed to indicate a position of the rotating shaft. The number of pulses it is desirable to generate between incoming pulses received by the phase locked loop is dependent upon the number of blades in the turbomachine. If the turbomachine were, for instance, to have 75 blades about a stage, then the phase lock loop and the decade counters would be preset to generate 75 individual pulses between pulse intervals. Hence, the time between successive pulses being supplied to the phase lock loop IC3 would be divided into 75 equally spaced pulses.

IC4 and IC5 are decade counters, each generating a signal which is directed to IC6 which is a two input AND gate. One decade counter is set for units and the other for tens. Hence, the decade counters will generate an output to AND gate IC6 when the units and tens count are correct such that IC6 will generate a signal through wire 44. This signal acts to reset through contact 3 IC3 such that the phase locked loop will generate another sequence of pulses dividing the next shaft rotation into a series of equally spaced position signals. The output from terminal 4 of IC3 is directed through wire 46 to both IC4 and additionally to IC7 which is a unit decade counter. IC7 is paired with IC8 which is a ten decade counter such that the two may be used together in conjunction with 2 input AND gate IC9 to effectively determine which blade will be illuminated.

Unit thumbwheel 50 is shown located to receive a signal from units decade counter IC7. Tens thumbwheel 60 is shown located to receive the tens signal from decade counter IC8. The decade counters are designed to generate a signal when the appropriate pulse count is received. Hence, for blade number 55 of 75, the unit decade counter would generate a signal at terminal 1 corresponding to the number 5 once every 10 pulses generated to the phase locked loop. Decade counter IC8 would generate a pulse at the terminal connected to number 5 only when the ten decade counter is in the 5 position or for pulse numbers 50 through 59. Hence, should both thumbwheel switches be set on the numeral 5 then the pulse would be directed from the units decades counter IC7 each time the pulse count gets to 5 in the unit position and from the tens decade counter which enters a pulse each time the pulse count gets to 5 in the tens position. When both of these conditions are met, signals are passed through IC10 which is a 2 input AND gate and the signal is emitted through wire 58 to wire 42 to strobe the pulse. Hence, in the circumstance as indicated, whenever the pulse count gets to 55 the strobe would be energized such that the blade corresponding thereto would be illuminated.

The example used is for a turbomachine stage having 75 equally spaced blades about the perimeter thereof and the thumbwheels being set to illuminate the 55th blade, then upon the 55th pulse from the phase lock loop being generated through the two decade counters and the thumbwheel switches, the signals would be provided to IC10 which will act to energize the strobe to illuminate the 55th blade.

Between IC10 and wire 42 it is additionally shown that the option 110 may be connected to the circuit. Option 110 is an automatic sequencing circuit such that the blade to be illuminated may be indexed about the turbomachine to allow inspection of more than one blade. Thumbwheel switches are provided to allow the operator to manually select which blade he desires to inspect. Any blade may be viewed by merely inserting the corresponding number in the unit and tens thumbwheels. When the option 110 is used the control automatically sequences the blade to be viewed obviating the necessity of the operator constantly changing the thumbwheel positions.

Figure 3:
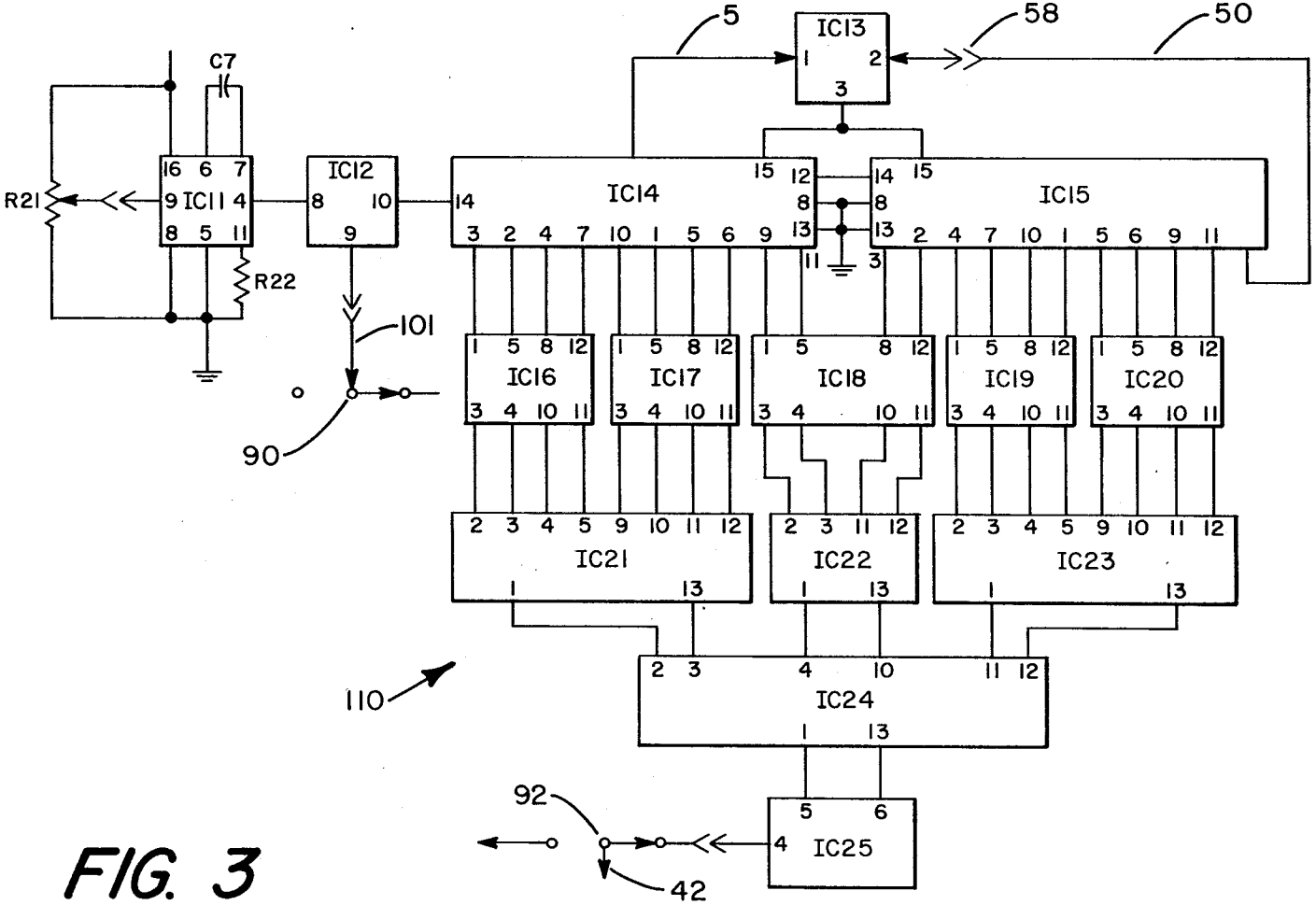
FIG. 3 is a schematic diagram of a circuit for indexing which blade will be subject to inspection.

FIG. 3 is a schematic diagram of option 110 designed to automatically sequence the strobe light to allow inspection of varying blades. IC11 is a phase locked loop oscillator which generates a periodic signal indicatative of the dwell time desired for viewing of each blade before the system sequences to the following blade. IC11 generates a signal which flows to two input AND gate IC12. IC12 additionally receives a signal from switch 90 to indicate whether it was in the run position or hold position. In the hold position the control will not act to sequence the strobe to the next blade but will continue to illuminate the blade currently being illuminated. In the run position, the second input to the AND gate is provided such that IC14 may be additionally indexed.

IC13 has the same function as IC6 in FIG. 2 and shall be connected in the same manner. The signal from IC13 is then divided and directed to both IC14 and IC15. IC14 is a unit decade counter and IC15 is a tens decade counter. Therefrom, under the appropriate conditions, signals are generated. Appropriate signals must also be available from IC7 and IC8 of FIG. 2. Signals are then directed to a series of integrated circuits labeled IC16 through IC20. Each of these is a two input AND gate and from these AND gates the logic flows to integrated circuits IC21, 22 and 23. These three devices are dual four input OR gates. From them the logic flows to IC24 which is another multiple input OR gate. From there the logic flows to IC23 which is a two input AND gate. When switch 92 is in the automatic position, as shown, contact is made between wire 42 and the AND gate such that the strobe is illuminated at the appropriate time. In the manual position, switch 92 is arranged such that the operator must move the thumbwheels 50 and 60 as shown in FIG. 2 to set which blade it is desired to illuminate.

Briefly, a circuit allows incoming pulses as received to be conditioned through a series of logic steps to generate a resultant signal. On a periodic basis phase locked loop IC11 acts to generate an additional signal which is added to the units counter IC14 such that the logic is stepped one blade away from its original position. By providing this stepping function, the strobe is sequenced such that blades may be inspected in order. The length of time that any one particular blade is inspected is set by directing the dwell time of the blade at the phase lock loop IC11.

The following is a table of electrical components indicated in the two circuits and their corresponding selection numbers.

| Integrated Circuit (IC) | IC Number |
|---|---|
| IC1 | 4093 |
| IC2 | 4093 |
| IC3 | 4046 |
| IC4 | 4017 |
| IC5 | 4017 |
| IC6 | 4081 |
| IC7 | 4017 |
| IC8 | 4017 |
| IC9 | 4081 |
| IC10 | 4081 |
| IC11 | 4046 |
| IC12 | 4081 |
| IC13 | 4081 |
| IC14 | 4017 |
| IC15 | 4017 |
| IC16 | 4081 |
| IC17 | 4081 |
| IC18 | 4081 |

-continued

| Integrated Circuit (IC) | IC Number |
|---|---|
| IC19 | 4081 |
| IC20 | 4081 |
| IC21 | 4072 |
| IC22 | 4072 |
| IC23 | 4072 |
| IC24 | 4072 |
| IC25 | 4081 |
| IC25 | 4081 |

The invention has been described herein with reference to a particular embodiment. It is to be understood by those skilled in the art that variations and modifications can be effected within the spirit and scope of the invention.

What is claimed is:

1. A method of monitoring the condition of blades mounted to a rotary shaft in a turbomachine which comprises the steps of:

detecting the rotational position of the shaft;

generating a signal in response to the position of the shaft;

dividing the signal into a plurality of position signals each representing a portion of a revolution of the shaft;

determining the rotational position of the shaft by monitoring the position signals; and illuminating at least one blade when the step of determining ascertains the shaft is in a rotational position such that the blade to be inspected is in the desired position.

2. The method as set forth in claim 1 and further including indexing the step of illuminating at periodic intervals to effectively illuminate different blades of the turbomachine.

3. The method as set forth in claim 1 wherein the turbomachine has a fixed number of blades and wherein the step of dividing includes dividing the signal into the same fixed number of position signals such that each position signal represents when a blade is in the desired position.

4. The method as set forth in claim 1 and further comprising the step of:

transmitting an image of the illuminated blade to a viewing station.

5. Apparatus for inspecting the blades mounted on a shaft in a turbomachine which comprises:

a detector for ascertaining when the shaft is in a preselected rotational position and generating a signal in response thereto;

means for dividing the signal into a series of position signals each representing a rotational position of the shaft;

a strobe means for illuminating a blade to be inspected; and means for triggering the strobe means in response to the position signals when the blade is in the desired position.

6. The apparatus as set forth in claim 5 and further comprising camera means for receiving and transmitting a visual image of the blade illuminated.

7. The apparatus as set forth in claim 5 wherein the means for dividing acts to divide the signal into a fixed number of equally spaced position signals, said fixed number being the same as the number of blades of the turbomachine.

8. The apparatus as set forth in claim 7 wherein the means for dividing comprises a phase locked loop circuit which generates position signals and counter means for inputting the desired number of position signals per signal.

9. The apparatus as set forth in claim 5 wherein the means for triggering further comprises counter means and position selector means, said strobe means being triggered when said counter means equals the value of the position selector means.

10. The apparatus as set forth in claim 5 and further comprising indexing means for periodically changing the blade which is illuminated such that different blades may be sequentially inspected.

11. An add-on package of apparatus for inspecting blades mounted on a shaft in a turbomachine having a rotational speed indicator which generates a signal in response to each rotation of the shaft which comprises:

means for receiving said signal and dividing said signal into a plurality of position signals each representing a rotational position of the shaft;

strobe means for illuminating a blade for inspection; and trigger means for initiating the strobe means in response to said position signals when the blade to be inspected is in the desired position.

12. The apparatus as set forth in claim 11 and further comprising camera means for receiving and transmitting a visual image of the blade illuminated.

13. The apparatus as set forth in claim 11 wherein the means for dividing acts to divide the signal into a fixed number of equally spaced position signals, said fixed number being the same as the number of blades to be inspected.

14. The apparatus as set forth in claim 13 wherein the means for dividing comprises a phase locked loop circuit which generates position signals and counter means for inputting the desired number of position signals per signal.

15. The apparatus as set forth in claim 11 wherein the means for triggering further comprises counter means and position selector means, said strobe means being triggered when said counter means equals the value of the position selector means.

16. The apparatus as set forth in claim 11 and further comprising indexing means for periodically changing the blade which is illuminated such that different blades may be sequentially inspected.

* * * * *